US010446974B2

(12) United States Patent
Luo

(10) Patent No.: US 10,446,974 B2
(45) Date of Patent: Oct. 15, 2019

(54) ELECTRICAL CONNECTOR HAVING AN ARC SUPPRESSION ELEMENT

(71) Applicant: TE CONNECTIVITY CORPORATION, Berwyn, PA (US)

(72) Inventor: Xiaoming Luo, Hummelstown, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 15/709,637

(22) Filed: Sep. 20, 2017

(65) Prior Publication Data

US 2019/0089091 A1 Mar. 21, 2019

(51) Int. Cl.

| | |
|---|---|
| ***H01R 13/53*** | (2006.01) |
| *H01R 13/66* | (2006.01) |
| *H01R 13/03* | (2006.01) |

(52) U.S. Cl.

CPC ..... *H01R 13/53* (2013.01); *H01R 13/03* (2013.01); *H01R 13/6616* (2013.01)

(58) Field of Classification Search

CPC ..... H01R 13/53

See application file for complete search history.

(56) References Cited

U.S. PATENT DOCUMENTS

| | | | | |
|---|---|---|---|---|
| 6,537,091 | B2 * | 3/2003 | Hirai | H01R 13/035 439/181 |
| 6,537,092 | B2 * | 3/2003 | Hirai | H01R 13/53 439/181 |
| 6,659,783 | B2 | 12/2003 | Copper et al. | |
| 7,059,879 | B2 * | 6/2006 | Krause | H01R 13/53 439/181 |
| 7,384,287 | B2 * | 6/2008 | Hughes | H01H 9/085 439/181 |
| 7,404,724 | B1 * | 7/2008 | Miller | H01R 13/6485 439/108 |
| 8,469,731 | B2 * | 6/2013 | Gloaguen | H01R 13/187 439/181 |
| 9,537,265 | B1 | 1/2017 | Juds et al. | |
| 2002/0064986 | A1 | 5/2002 | Hirai et al. | |
| 2002/0106921 | A1 | 8/2002 | Hirai et al. | |
| 2007/0026713 | A1 * | 2/2007 | Hughes | H01R 13/53 439/181 |
| 2017/0018886 | A1 | 1/2017 | Juds et al. | |

* cited by examiner

*Primary Examiner* — Tho D Ta

(57) ABSTRACT

An electrical connector matable to and unmatable from a separable mating electrical connector includes a housing having a terminal channel and a secondary channel. The electrical connector also includes a female terminal received in the terminal channel. The female terminal is matable with and unmatable from a mating male terminal of the mating electrical connector. An arc suppression element is received in the secondary channel. The arc suppression element configured to electrically couple between the female terminal and the male terminal immediately after the female terminal is disengaged from the male terminal, the arc suppression element providing a bypass between the female terminal and the male terminal so that arcing does not occur when the female terminal is disconnected from the male terminal of the mating electrical connector.

20 Claims, 2 Drawing Sheets

ELECTRICAL CONNECTOR HAVING AN ARC SUPPRESSION ELEMENT

BACKGROUND OF THE INVENTION

The subject matter herein relates generally to an electrical connector having an arc suppression element that suppresses or prevents an electrical arc during disconnection.

Disconnection or separation of electrical connectors and/or terminals with live electrical power can cause electrical arcing, which can damage the connector, contacts, and/or terminals. The amount of arc damage experienced by the terminals depends on their physical structure, the load current, the supply voltage, the speed of separation, and the characteristics of the load (e.g. resistive, capacitive, inductive) as well as other factors. For example, repeated engagement and disengagement of male and female terminals may cause the ends of the male terminal to melt and shift towards the base end of the male terminal. As a result, the male terminal may become deformed causing poor contact with the female terminal.

Arcing is particularly a risk in high voltage applications, such as automotive, relays, motors, batteries, inverters, and the like. Various types of electrical connectors are used in high voltage applications, such as single-pin connectors, multi-pin connectors, micro-miniature connectors, and the like. Future electrical systems are expected to utilize high voltage to handle the increasing amount of electrical loads in applications. This increased voltage could cause significant damage to present connectors. For instance, electrical connectors under load could become disengaged, such as during operation, leading to arcing. Conventional electrical connectors require either that the current be shut off before the terminals are separated or unmated, or employ a sacrificial terminal portion. Components that ensure shut off of the current may include circuits that shut off the current prior to separation, which may include FET components or may have complex locking features that provide staged unlocking and separation. The cost, space, reliability, safety, performance and complexity of these conventional solutions make them unsuitable for many applications.

Accordingly, there is a need for an electrical connector that allow disconnection of a live connection without arcing.

BRIEF DESCRIPTION OF THE INVENTION

In one embodiment, an electrical connector matable to and unmatable from a separable mating electrical connector is provided that includes a housing having a terminal channel and a secondary channel. The electrical connector also includes a female terminal received in the terminal channel, the female terminal being matable with and unmatable from a mating male terminal of the mating electrical connector. The electrical connector also includes an arc suppression element received in the secondary channel forward of the female terminal, the arc suppression element configured to electrically couple between the female terminal and the male terminal immediately after the female terminal is disengaged from the male terminal, the arc suppression element providing a bypass between the female terminal and the male terminal so that arcing does not occur when the female terminal is disconnected from the male terminal of the mating electrical connector.

In yet another embodiment, an electrical connector matable to and unmatable from a separable mating electrical connector is provided that includes a housing having a terminal channel and a secondary channel. The electrical connector also includes a female terminal received in the terminal channel, the female terminal being matable with and unmatable from a mating male terminal of the mating electrical connector. The electrical connector also includes an arc suppression element received in the secondary channel. The female terminal is separable from the mating male terminal before the female terminal is disconnected from a circuit including the mating male terminal of the mating electrical connector so that the resistance in the arc suppression element increases after disconnection of the female terminal from the mating male terminal and prior to disconnection of the female terminal from the circuit so that both the male terminal and the female terminal can be disconnected without arcing.

DETAILED DESCRIPTION OF THE INVENTION

Embodiments described herein include electrical devices (e.g., electrical connectors, contacts, terminals, cables, and the like) that have an electrical connector, a mating electrical connector, and an arc suppression element to protect the connectors from damage due to arcing when intentionally or unintentionally disconnected. The electrical connector may have a variety of configurations as set forth herein.

Figure 1:
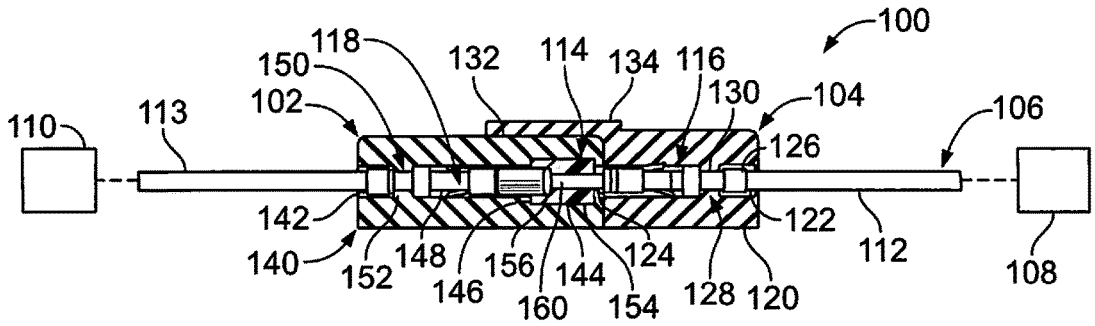
FIG. 1 is a cross-sectional view of a power connector system with an electrical connector and a mating electrical connector in an engaged position according to an embodiment.
Figure 2:
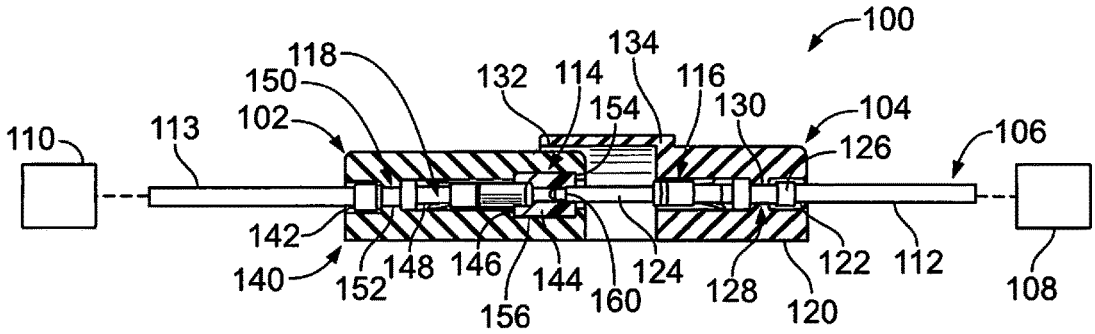
FIG. 2 is a cross-sectional view of the power connector system with the electrical connector and the mating electrical connector in a disengaging position according to an embodiment.
Figure 3:
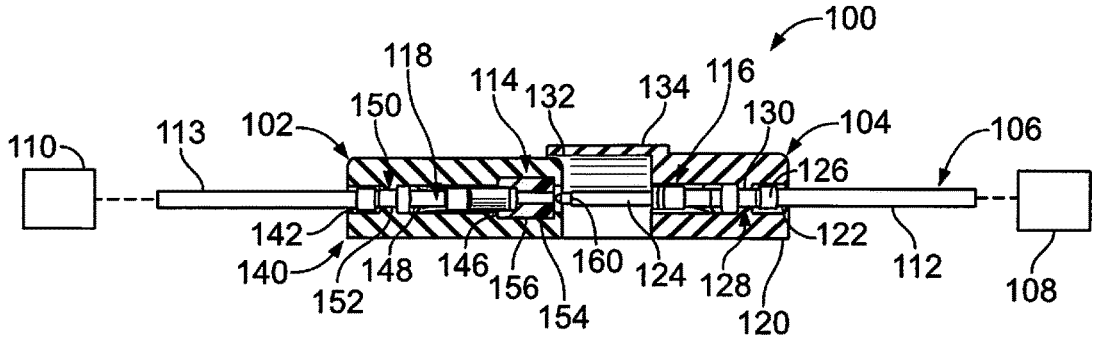
FIG. 3 is a cross-sectional view of the power connector system with the electrical connector and the mating electrical connector in a disengaged position according to an embodiment.

FIG. 1 is a cross-sectional view of a power connector system 100 including an electrical connector 102 matable to and unmatable from a mating electrical connector 104 shown in an engaged position according to an embodiment. FIG. 2 is a cross-sectional view of the power connector system 100 with the electrical connector 102 and mating electrical connector 104 in a disengaging position. FIG. 3 is a cross-sectional view of the power connector system 100 with the electrical connector 102 and the mating electrical connector 104 in a disengaged position.

The power connector system 100 includes a main power circuit 106 having a load 108 and a power supply 110 (e.g. a battery) electrically connected by the electrical connectors 102, 104 and wires 112 and 113. In an exemplary embodiment, the main power circuit 106 is a high voltage power circuit, such as a 96-volt, 20 Amp DC power circuit. However, the main power circuit 106 may be used with any voltage in the system, including a higher voltage. The main power circuit 106 may be used in an automotive application, such as in a vehicle. However, the power connector system 100 may have applications other than automotive applications in alternative embodiments, including, but not limited to relays, motors, batteries, inverters, and the like.

The electrical connector 102 includes an arc suppression element 114 to protect the components of the power connector system 100 from damage due to arcing when the electrical connectors 102, 104 are intentionally or unintentionally disconnected. The arc suppression element 114 allows the disconnection of the electrical connectors 102, 104 when the main power circuit 106 has a live connection making the electrical connectors 102, 104 hot swappable. In various embodiments, the arc suppression element 114 is composed of a conductive polymer, a variable resistive material, such as a positive temperature coefficient material that varies resistance to current based on temperature, and the like.

In the illustrated embodiment, the electrical connector 102 and mating electrical connector 104 are single-pin connectors having a male terminal 116 and female terminal 118 configured to mate and unmate for electrical connection and disconnection to an electrical device, such as a battery or a power distribution unit. For example, the mating electrical connector 104 defines a plug connector and may also be referred to hereinafter as a plug connector 104. The electrical connector 102 defines a socket connector and may also be referred to hereinafter as a socket connector 102. The mating electrical or plug connector 104 is configured to be plugged into the electrical or socket connector 102 along a central longitudinal axis. In alternate embodiments, the connectors 102 and 104 may comprise other types of connectors, including, but not limited to multi-pin connectors, micro-miniature connectors, and the like. Furthermore, the connectors 102 and 104 may be formed by any suitable method, such as stamping, forging, casting, and the like.

The plug connector 104 includes a housing 120 having a plug terminal channel 122 configured to receive the male terminal 116. In an exemplary embodiment, the male terminal 116 may include a pin with a mating end 124 configured for mating with the female terminal 118 of the socket connector 102 and a wire end 126 at the opposite end configured for electrical connection to the corresponding wire 112. For example, the wire 112 may be crimped to the wire end 126. However, other types of connections can be used to connect the wire 112 to the wire end 126, such as, barrel connection, butt connection, cap connection, and the like. In the illustrated embodiment, the male terminal 116 is a pin terminal. However, other types of terminals may be used in alternative embodiments, such as a post, jack, plug, blade terminal, spade terminal, fork terminal, contact, and the like.

The housing 120 includes a securing feature 128 to secure the male terminal 116 within housing 120 and retain the relative positioning and orientation relative to the housing 120. In the illustrated embodiment, the securing feature 128 is a rib extending inwardly from the wall of the plug terminal channel 122 configured to seat within a slot 130 of the male terminal 116. Optionally, other types of securing features may be used to secure the male terminal 116 in the plug terminal channel 122, such as tab, a latch, a retaining member, a mechanical interference fit, bonding, adhesive, and the like.

The housing 120 includes a guide flange 132 extending outward from a front end 134 of the housing 120. The guide flange 132 may be used to guide mating of the plug connector 104 with the socket connector 102. The guide flange 132 may be positioned along the periphery of at least a portion of the housing 120 where the guide flange 132 does not block the mating and unmating of the terminals 116 and 118. Other types of guide features may be used in alternative embodiments, such as slots, keys, or other types of guide features.

The housing 120 may be formed of a dielectric material, such as plastic or one or more other polymers. Optionally, the housing 120 may be overmolded or injection molded around the male terminal 116. For example, the housing 120 may include an overmolded body molded around the wire end 126 of the male terminal 116 with the mating end 124 extending outwardly from the housing 120 along the central longitudinal axis. Alternatively, the body of the housing 120 may be formed, such as by molding, and then the male terminal 116 loaded into the plug terminal channel 122. The male terminal 116 has a length that is less than a length of the guide flange 132 so that the guide flange 132 makes initial contact with the socket connector 102 to guide mating of the male terminal 116 with the female terminal 118.

The socket connector 102 includes a housing 140 having a socket terminal channel 142 configured to receive the female terminal 118, and a secondary channel 144 or pocket configured to receive the arc suppression element 114. In an exemplary embodiment, the female terminal 118 may be a socket with a mating end 146 configured for mating with the male terminal 116 of the plug connector 104, and a wire end 148 at the opposite end configured for electrical connection to the corresponding wire 113. For example, the wire 113 may be crimped to the wire end 148. However, other types of connections can be used to connect the wire 113 to the wire end 148, such as, barrel connection, butt connection, cap connection, and the like. In the illustrated embodiment, the female terminal 118 is a socket terminal. However, other types of terminals may be used in alternative embodiments, such as a female receptacle for a post, jack, plug, blade terminal, spade terminal, fork terminal, contact, and the like.

The housing 140 includes a securing feature 150 to secure the female terminal 118 within housing 140 and retain the relative positioning and orientation relative to the housing 140. In the illustrated embodiment, the securing feature 150 is a rib extending inwardly from the wall of the socket terminal channel 142 configured to seat within a slot 152 of the female terminal 118. Optionally, other types of securing features may be used to secure the male terminal 116 in the plug terminal channel 122, such as tab, a latch, a retaining member, a mechanical interference fit, bonding, adhesive, and the like.

The housing 140 may be formed of a dielectric material, such as plastic or one or more other polymers. Optionally, the housing 140 may be overmolded or injection molded around the female terminal 118. For example, the housing 140 may include an overmolded body molded around the wire end 148 of the female terminal 118 with at least a portion of the mating end 146 extending outwardly from the socket terminal channel 142 into the secondary channel 144 along the central longitudinal axis. Alternatively, the body of the housing 140 may be formed, such as by molding, and then the female terminal 118 loaded into the socket terminal channel 142.

The electrical connector 102 includes the arc suppression element 114 received in the secondary channel 144 and electrically coupled to the female terminal 118, the combination of which is in parallel with the male terminal 116 along the central longitudinal axis. The secondary channel 144 may be sized to allow the arc suppression element 114 to expand, such as when heated. In the illustrated embodiment, the arc suppression element 114 includes a substantially cylindrical body extending between a front end 154 and a back end 156 and defining an arc channel 160 positioned along the central longitudinal axis. However, the arc suppression element 114 may have any size or shape depending on the particular application. The arc channel 160 receives the mating end 124 of the male terminal 116. Optionally, the arc channel 160 may guide the male terminal 116 into the female terminal 118. Optionally, the arc channel 160 may be chamfered at the front end 154 to prevent stubbing during mating. In alternate embodiments, the electrical connector 102 may be configured to include multiple arc suppression elements 114 to protect from arcing between a plurality of male and female terminals during mating and unmating for multiple circuits. Optionally, a single arc suppression element may be configured to protect from arcing between a plurality of male and female terminals during mating and unmating for multiple circuits.

In an exemplary embodiment, the female terminal 118 is configured to disconnect first. For example, the female terminal 118 is staggered or recessed rearward from the front end 154 of the arc suppression element 114. In an exemplary embodiment, the arrangement of components parts and incorporation of the electrical connector 102 prevent arcing when the electrical connectors 102, 104 are unmated while carrying current. In the illustrated embodiment, the arc suppression element 114 is only employed in the electrical connector 102. However, the arc suppression element 114 may additionally or alternatively be employed in the mating electrical connector 104.

In an exemplary embodiment, the arc suppression element 114 is formed from a variable resistive material configured to vary resistance from a low resistance state to a high resistance state to create a variable resistance path between the terminals 116, 118 during unmating. The arc suppression element 114 may be composed of a positive temperature coefficient resistive material that varies resistance based on temperature, such as, the resistance may increase as the temperature increases. As an exemplary example, the arc suppression element may be composed of a non-conductive polymer with conductive particles immersed in a non-conductive polymer matrix. For example, the non-conductive polymer may be a semi-crystalline thermoplastic resin including, but not limited to, polyethylene (PE), including high-density polyethylene (HDPE), linear low-density polyethylene (LLDPE), low-density polyethylene (LDPE), medium-density polyethylene (MDPE). The conductive particles may be metal powders, metal-coated particles, flakes, or any other conductive, metal-containing particles. Optionally, the conductive particles may be carbonaceous fillers such as carbon black, carbon nanotubes, carbon fibers and graphite, or the like, or a combination of materials.

Increased resistive heating ($I^2R$) caused by current flowing through the variable resistance path of the arc suppression element 114 causes the non-conductive polymer to expand to disrupt conductive paths formed by interconnected conductive particles. For example, as the temperature increases, the polymer material expands and swells, which causes the distance between the conductive particles to increase, thereby increasing the resistivity of the overall material and increasing the resistance of the arc suppression element 114.

The arc suppression element 114 is characterized in that an increase in electrical resistance of the arc suppression element 114 lags an inrush current through the arc suppression element 114 so that the arc suppression element 114 carries a current approximately equal to the inrush current for a period of time referred to as a separation time. The separation time is the time it takes for the non-conductive polymer to expand to a point that the conductive paths formed by the interconnected conductive particles no longer carry enough current to sustain arcing, thus having a current that is below an arcing threshold so that arcing does not occur upon disconnection of the electrical connectors 102, 104. The separation time is long enough for resistance in the arc suppression element 114 to increase sufficiently to reduce the current through the variable resistive path through the arc suppression element 114 below the arcing threshold so that arcing does not occur. The separation time is long enough to allow the arc suppression element 114 to switch from a first relatively low resistance state to a second relatively higher resistance state. In an exemplary embodiment, the resistance of the arc suppression element 114 increases sufficiently rapidly between separation of the female terminal 118 and disconnection of the male terminal 116 so that the electrical energy flowing through the male terminal 116 is reduced below an arcing threshold after separation of the female terminal 118 and before disconnection of the male terminal 116.

As shown in FIG. 1, during normal operation when the electrical connectors 102, 104 are fully mated in an engagement position, the female terminal 118 is carrying a high current. The current is primarily flowing between the female terminal 118 and the male terminal 116. Only a relatively small shunt or bypass current flows through the arc suppression element 114.

As shown in FIG. 2, when the electrical connectors 102, 104 are initially unmated to a disengaging position, the female terminal 118 separates and is disconnected from the male terminal 116, while the arc suppression element 114 maintains an electrical connection in the form of a variable resistance path between the terminals 116, 118. The male terminal 116 is disengaged from the female terminal 118 in such position, but is still located in the arc suppression element 114. It is while the terminals 116, 118 are in this initial disengaging position or disconnect state that arcing between the two electrical connectors 102, 104 is most likely when the voltage and current are above an arcing threshold, since a relatively large existing current is being disconnected. However, the arc suppression element 114 limits the voltage and current across the opening gap to prevent arcing. When the terminals 116, 118 initially physically separate, the arc suppression element 114 has a low resistance state since there was only a small amount of current flowing through the arc suppression element 114 prior to separation, causing the resistive heating of the arc suppression element 114 to remain low. While remaining electrically connected through the arc suppression element 114, as the terminals 116, 118 continue to separate, current through the arc suppression element 114 increases. The resulting resistive heating increases the electrical resistance of the arc suppression element 114. As the resistance increases, the arc suppression element 114 will effectually open or, in other words, its resistance will significantly increase to a point where the circuit is no longer effectively conducting power, as shown in FIG. 3, when the electrical connectors 102, 104 are completely unmated in the disengaged position.

At this point there will be insufficient electrical energy to support an arc between the terminals 116, 118. The amount of time that elapses while the electrical connectors 102, 104 are unmating allows the current to fall below the arcing threshold before the female terminal 118 is physically disconnected from the male terminal 116. Since current is no longer flowing through the electrical connectors 102, 104, the arc suppression element 114 will return or reset to a state of lower temperature and resistance.

Figure 4:
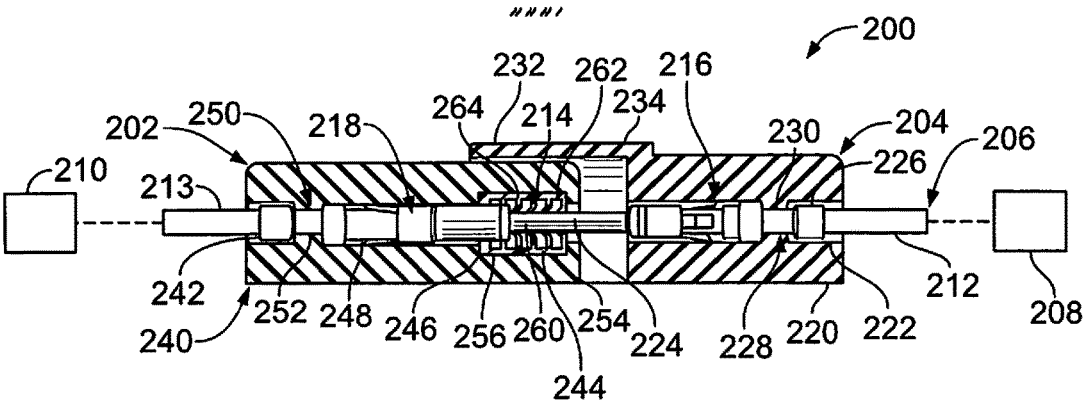
FIG. 4 is a cross-sectional view of a power connector system with an electrical connector and a mating electrical connector in an engaged position according to another embodiment.
Figure 5:
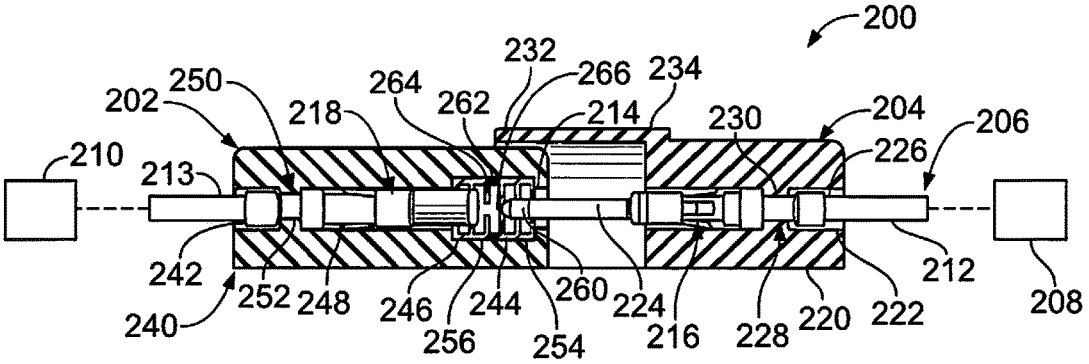
FIG. 5 is a cross-sectional view of the power connector system with the electrical connector and the mating electrical connector in a disengaging position according to another embodiment.
Figure 6:
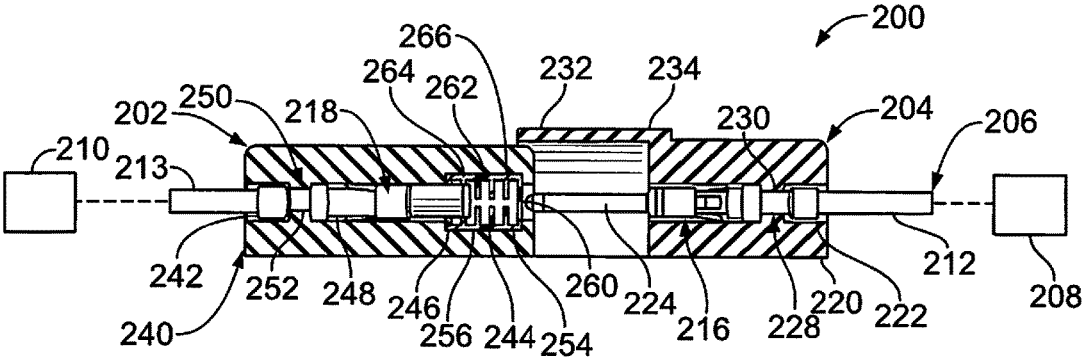
FIG. 6 is a cross-sectional view of the power connector system with the electrical connector and the mating electrical connector in a disengaged position according to another embodiment.

FIG. 4 is a cross-sectional view of a power connector system 200 including an electrical connector 202 matable to and unmatable from a mating electrical connector 204 shown in an engaged position according to an embodiment. FIG. 5 is a cross-sectional view of the power connector system 200 with the electrical connector 202 and mating electrical connector 204 in a disengaging position. FIG. 6 is a cross-sectional view of the power connector system 200 with the electrical connector 202 and the mating electrical connector 204 in a disengaged position. The embodiment of FIGS. 4-6 is similar to the embodiment of FIGS. 1-3, except for a different configuration of the arc suppression element 214 that includes contact elements 264 configured for contacting female and male terminals 216, 218.

The power connector system 200 includes a main power circuit 206 having a load 208 and a power supply 210 (e.g. a battery) electrically connected by the electrical connectors 202, 204 and wires 212 and 213. In an exemplary embodiment, the main power circuit 206 is a high voltage power circuit, such as a 48-volt DC power circuit. However, the main power circuit 206 may be used with any voltage in the system, including a higher voltage. The main power circuit 206 may be used in an automotive application, such as in a vehicle. However, the power connector system 200 may have applications other than automotive applications in alternative embodiments, including, but not limited to relays, motors, batteries, inverters, and the like.

The electrical connector 202 includes an arc suppression element 214 to protect the components of the power connector system 200 from damage due to arcing when the electrical connectors 202, 204 are intentionally or unintentionally disconnected. The arc suppression element 214 allows the disconnection of the electrical connectors 202, 204 when the main power circuit 206 has a live connection making the electrical connectors 202, 204 hot swappable. In various embodiments, the arc suppression element 214 is composed of a conductive polymer, a variable resistive material, such as a positive temperature coefficient material that varies resistance to current based on temperature, and the like.

In the illustrated embodiment, the electrical connector 202 and mating electrical connector 204 are single-pin connectors having a male terminal 216 and female terminal 218 configured to mate and unmate for electrical connection and disconnection to an electrical device, such as a battery or a power distribution unit. For example, the mating electrical connector 204 defines a plug connector and may also be referred to hereinafter as a plug connector 204. The electrical connector 202 defines a socket connector and may also be referred to hereinafter as a socket connector 202. The mating electrical or plug connector 204 is configured to be plugged into the electrical or socket connector 202 along a central longitudinal axis. In alternate embodiments, the connectors 202 and 204 may comprise other types of connectors, including, but not limited to multi-pin connectors, micro-miniature connectors, and the like. Furthermore, the connectors 202 and 204 may be formed by any suitable method, such as stamping, forging, casting, and the like.

The plug connector 204 includes a housing 220 having a plug terminal channel 222 configured to receive the male terminal 216. In an exemplary embodiment, the male terminal 216 may include a pin with a mating end 224 configured for mating with the female terminal 218 of the socket connector 202 and a wire end 226 at the opposite end configured for electrical connection to the corresponding wire 212. For example, the wire 212 may be crimped to the wire end 226. However, other types of connections can be used to connect the wire 212 to the wire end 226, such as, barrel connection, butt connection, cap connection, and the like. In the illustrated embodiment, the male terminal 216 is a pin terminal. However, other types of terminals may be used in alternative embodiments, such as a post, jack, plug, blade terminal, spade terminal, fork terminal, contact, and the like.

The housing 220 includes a securing feature 228 to secure the male terminal 216 within housing 220 and retain the relative positioning and orientation relative to the housing 220. In the illustrated embodiment, the securing feature 228 is a rib extending inwardly from the wall of the plug terminal channel 222 configured to seat within a slot 230 of the male terminal 216. Optionally, other types of securing features may be used to secure the male terminal 216 in the plug terminal channel 222, such as tab, a latch, a retaining member, a mechanical interference fit, bonding, adhesive, and the like.

The housing 220 includes a guide flange 232 extending outward from a front end 234 of the housing 220. The guide flange 232 may be used to guide mating of the plug connector 204 with the socket connector 202. The guide flange 232 may be positioned along the periphery of at least a portion of the housing 220 where the guide flange 232 does not block the mating and unmating of the terminals 216 and 218. Other types of guide features may be used in alternative embodiments, such as slots, keys, or other types of guide features.

The housing 220 may be formed of a dielectric material, such as plastic or one or more other polymers. Optionally, the housing 220 may be overmolded or injection molded around the male terminal 216. For example, the housing 220 may include an overmolded body molded around the wire end 226 of the male terminal 216 with the mating end 224 extending outwardly from the housing 220 along the central longitudinal axis. Alternatively, the body of the housing 220 may be formed, such as by molding, and then the male terminal 216 loaded into the plug terminal channel 222. The male terminal 216 has a length that is less than a length of the guide flange 232 so that the guide flange 232 makes initial contact with the socket connector 202 to guide mating of the male terminal 216 with the female terminal 218.

The socket connector 202 includes a housing 240 having a socket terminal channel 242 configured to receive the female terminal 218, and a secondary channel 244 or pocket configured to receive the arc suppression element 214. In an exemplary embodiment, the female terminal 218 may be a socket with a mating end 246 configured for mating with the male terminal 216 of the plug connector 204, and a wire end 248 at the opposite end configured for electrical connection to the corresponding wire 213. For example, the wire 213 may be crimped to the wire end 248. However, other types of connections can be used to connect the wire 213 to the wire end 248, such as, barrel connection, butt connection, cap connection, and the like. In the illustrated embodiment, the female terminal 218 is a socket terminal. However, other types of terminals may be used in alternative embodiments, such as a female receptacle for a post, jack, plug, blade terminal, spade terminal, fork terminal, contact, and the like.

The housing 240 includes a securing feature 250 to secure the female terminal 218 within housing 240 and retain the relative positioning and orientation relative to the housing 240. In the illustrated embodiment, the securing feature 250 is a rib extending inwardly from the wall of the socket terminal channel 242 configured to seat within a slot 252 of the female terminal 218. Optionally, other types of securing features may be used to secure the male terminal 216 in the plug terminal channel 222, such as tab, a latch, a retaining member, a mechanical interference fit, bonding, adhesive, and the like.

The housing 240 may be formed of a dielectric material, such as plastic or one or more other polymers. Optionally, the housing 240 may be overmolded or injection molded around the female terminal 218. For example, the housing 240 may include an overmolded body molded around the wire end 248 of the female terminal 218 with at least a portion of the mating end 246 extending outwardly from the socket terminal channel 242 into the secondary channel 244 along the central longitudinal axis. Alternatively, the body of the housing 240 may be formed, such as by molding, and then the female terminal 218 loaded into the socket terminal channel 242.

The electrical connector 202 includes the arc suppression element 214 received in the secondary channel 244 and electrically coupled to the female terminal 218, the combination of which is in parallel with the male terminal 216 along the central longitudinal axis. The secondary channel 244 may be sized to allow the arc suppression element 214 to expand, such as when heated. In the illustrated embodiment, the arc suppression element 214 includes a substantially cylindrical body extending between a front end 254 and a back end 256 and defining an arc channel 260 and an inner surface 262 positioned along the central longitudinal axis. However, the arc suppression element 214 may have any size or shape depending on the particular application.

At least one contact element 264 extends from the inner surface 262 and is configured for contacting with at least a portion of the female terminal 218 and/or the male terminal 216. In the exemplary embodiment, a plurality of contact elements 264 are spaced along a length of the arc channel 260. However, the arc suppression element 214 can include any number, including one, of contact elements 264 positioned at any spacing. Each contact element 264 is a generally annular member extending inwardly to define an opening 266 along the central longitudinal axis. The opening 266 is configured to provide for contact between the contact element 264 and the terminals 216, 218. For example, a diameter of the opening 266 may be less than a diameter of an outer surface of the mating end 264 the female terminal 218 and/or a diameter of the mating end 224 male terminal 216. Optionally, each contact element 264 may be any configuration that provides contact with the terminals 216, 218 including, but not limited to, a finger, a flap, a fin, a brush, and the like, or any combination thereof. The contact elements 264 may be flexible so that as contact is made with the terminals 216, 218, the contact elements 264 flex or bend to maintain contact and reduce friction therebetween. In addition, the flexibility of the contact elements 264 may allow air to expel from the arc channel 260.

The arc channel 260 and contact elements 264 receive the mating end 224 of the male terminal 216. Optionally, the arc channel 260 and contact elements 264 may guide the male terminal 216 into the female terminal 218. Optionally, the arc channel 260 may be chamfered at the front end 254 to prevent stubbing during mating. In alternate embodiments, the electrical connector 202 may be configured to include multiple arc suppression elements 214 to protect arcing between a plurality of male and female terminals during mating and unmating for multiple circuits. Optionally, a single arc suppression element may be configured to protect arcing between a plurality of male and female terminals during mating and unmating for multiple circuits.

In an exemplary embodiment, the female terminal 218 is configured to disconnect first. For example, the female terminal 218 is staggered or recessed rearward from the front end 254 of the arc suppression element 214. In an exemplary embodiment, the arrangement of components parts and incorporation of the electrical connector 202 prevent arcing when the electrical connectors 202, 204 are unmated while carrying current. In the illustrated embodiment, the arc suppression element 214 is only employed in the electrical connector 202. However, the arc suppression element 214 may additionally or alternatively be employed in the mating electrical connector 204.

In an exemplary embodiment, the arc suppression element 214 is formed from a variable resistive material configured to vary resistance from a low resistance state to a high resistance state to create a variable resistance path between the terminals 216, 218 during unmating. The arc suppression element 214 may be composed of a positive temperature coefficient resistive material that varies resistance based on temperature, such as, the resistance may increase as the temperature increases. As an exemplary example, the arc suppression element may be composed of a non-conductive polymer with conductive particles immersed in a non-conductive polymer matrix. For example, the non-conductive polymer may be a semi-crystalline thermoplastic resin including, but not limited to, polyethylene (PE), including high-density polyethylene (HDPE), linear low-density polyethylene (LLDPE), low-density polyethylene (LDPE), mid-density polyethylene (MDPE). The conductive particles may be metal powders, metal-coated particles, flakes, or any other conductive, metal-containing particles. Optionally, the conductive particles may be carbonaceous fillers such as carbon black, carbon nanotubes, carbon fibers and graphite, or the like, or a combination of materials.

Increased resistive heating ($I^2R$) caused by current flowing through the variable resistance path of the arc suppression element 214 causes the non-conductive polymer to expand to disrupt conductive paths formed by interconnected conductive particles. For example, as the temperature increases, the polymer material expands and swells, which causes the distance between the conductive particles to increase, thereby increasing the resistivity of the overall material and increasing the resistance of the arc suppression element 114.

The arc suppression element 214 is characterized in that an increase in electrical resistance of the arc suppression element 214 lags an inrush current through the arc suppression element 214 so that the arc suppression element 214 carries a current approximately equal to the inrush current for a period of time referred to as a separation time. The separation time is the time it takes for the non-conductive polymer to expand to a point that the conductive paths formed by the interconnected conductive particles no longer carry enough current to sustain arcing, thus having a current that is below an arcing threshold so that arcing does not occur upon disconnection of the electrical connectors 202, 204. The separation time is long enough for resistance in the arc suppression element 214 to increase sufficiently to reduce the current through the variable resistive path through the arc suppression element 214 below the arcing threshold so that arcing does not occur. The separation time is long enough to allow the arc suppression element 214 to switch from a first relatively low resistance state to a second relatively higher resistance state. In an exemplary embodiment, the resistance of the arc suppression element 214 increases sufficiently rapidly between separation of the female terminal 218 and disconnection of the male terminal 216 so that the electrical energy flowing through the male terminal 216 is reduced below an arcing threshold after separation of the female terminal 218 and before disconnection of the male terminal 216.

As shown in FIG. 4, during normal operation when the electrical connectors 202, 204 are fully mated in an engagement position, the female terminal 218 is carrying a high current. The current is primarily flowing between the female terminal 218 and the male terminal 216. Only a relatively small shunt or bypass current flows through the arc suppression element 214.

As shown in FIG. 5, when the electrical connectors 202, 204 are initially unmated to a disengaging position, the female terminal 218 separates and is disconnected from the male terminal 216, while the arc suppression element 214 maintains an electrical connection in the form of a variable resistance path between the terminals 216, 218. The male terminal 216 is disengaged from the female terminal 218 in such position, but is still located in the arc suppression element 214. It is while the terminals 216, 218 are in this initial disengaging position or disconnect state that arcing between the two electrical connectors 202, 204 is most likely when the voltage and current are above an arcing threshold, since a relatively large existing current is being disconnected. However, the arc suppression element 214 limits the voltage and current across the opening gap to prevent arcing. When the terminals 216, 218 initially physically separate, the arc suppression element 214 has a low resistance state since there was only a small amount of current flowing through the arc suppression element 214 prior to separation, causing the resistive heating of the arc suppression element 214 to remain low. While remaining electrically connected through the arc suppression element 214, as the terminals 216, 218 continue to separate, current through the arc suppression element 214 increases. The resulting resistive heating increases the electrical resistance of the arc suppression element 214. As the resistance increases, the arc suppression element 214 will effectually open or, in other words, its resistance will significantly increase to a point where the circuit is no longer effectively conducting power, as shown in FIG. 6, when the electrical connectors 202, 204 are completely unmated in the disengaged position.

At this point there will be insufficient electrical energy to support an arc between the terminals 216, 218. The amount of time that elapses while the electrical connectors 202, 204 are unmating allows the current to fall below the arcing threshold before the female terminal 218 is physically disconnected from the male terminal 216. Since current is no longer flowing through the electrical connectors 202, 204, the arc suppression element 214 will return or reset to a state of lower temperature and resistance.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. An electrical connector matable to and unmatable from a separable mating electrical connector, the electrical connector comprising:

a housing having a terminal channel and a secondary channel;

a female terminal received in the terminal channel, the female terminal being matable with and unmatable from a male terminal of the mating electrical connector; and an arc suppression element received in the secondary channel forward of the female terminal, the arc suppression element configured to electrically couple between the female terminal and the male terminal immediately after the female terminal is disengaged from the male terminal, the arc suppression element including an arc channel configured to receive the female terminal and the male terminal therein, the arc suppression element providing a bypass between the female terminal and the male terminal so that arcing does not occur when the female terminal is disconnected from the male terminal of the mating electrical connector.

2. The electrical connector of claim 1, wherein the arc suppression element comprises a variable resistance material having an electrical resistance configured to increase in response to increasing voltage/current to reduce the flow of voltage/current through the female terminal after the female terminal is disconnected from the male terminal of the mating connector so that arcing does not occur when the female terminal is disconnected initially causing an increase in the flow of voltage/current through the arc suppression element.

3. The electrical connector of claim 2, wherein an increase in resistance in the variable resistance material lags an increase in current.

4. The electrical connector of claim 2, wherein the variable resistance material comprises a conductive polymer member with conductive particles immersed in a nonconductive polymer, increased resistive heating causing the nonconductive polymer to expand to disrupt conductive paths formed by interconnected conductive particles.

5. The electrical connector of claim 1, wherein the secondary channel is in alignment with the terminal channel along a longitudinal axis.

6. The electrical connector of claim 1, wherein the arc suppression element includes a front end and a rear end engaging and being electrically coupled to the female terminal.

7. The electrical connector of claim 1, wherein the arc suppression element expands when heated to electrically decouple the male terminal from the female terminal.

8. The electrical connector of claim 1, wherein the arc suppression element includes a contact element configured for contact with the male terminal.

9. The electrical connector of claim 1, wherein the arc suppression element comprises a positive temperature coefficient resistive material that is characterized in that an increase in electrical resistance of the arc suppression element lags an inrush current through the arc suppression element so that the arc suppression element carries a current approximately equal to the inrush current for a period of time.

10. The electrical connector of claim 1, wherein the female terminal is disconnected from a male terminal after a finite time interval from the disconnecting of the female terminal from the male terminal of the mating electrical connector, the finite time interval being long enough for resistance in the arc suppression element to increase sufficiently to reduce the current through the female terminal below an arcing threshold so that arcing does not occur upon disconnection of the female terminal.

11. The electrical connector of claim 1, wherein the arc suppression element comprises a positive temperature coefficient resistive member characterized by a finite separation time to switch from a first relatively low resistance state to a second relatively higher resistance state.

12. The electrical connector of claim 1, wherein the arc suppression element comprises a positive temperature coefficient resistive member, a resistance of the positive temperature coefficient resistor increases sufficiently rapidly between separation of the male terminal and disconnection of the female terminal so that electrical energy flowing through the female terminal is reduced below an arcing threshold after separation of the male terminal and before disconnection of the female terminal.

13. An electrical connector matable to and unmatable from a separable mating electrical connector, the electrical connector comprising:

a housing having a terminal channel and a secondary channel;

a female terminal received in the terminal channel, the female terminal being matable with and unmatable from a male terminal of the mating electrical connector; and an arc suppression element received in the secondary channel forward of the female terminal, the arc suppression element including an arc channel configured to receive the female terminal and the male terminal therein, wherein the female terminal is separable from the male terminal before the female terminal is disconnected from a circuit including the male terminal of the mating electrical connector so that the resistance in the arc suppression element increases after disconnection of the female terminal from the male terminal and prior to disconnection of the female terminal from the circuit so that male terminal and the female terminal can be disconnected without arcing.

14. The electrical connector of claim 13, wherein the arc suppression element comprises a variable resistance material having an electrical resistance configured to increase in response to increasing voltage/current to reduce the flow of voltage/current through the female terminal before the female terminal is disconnected from the male terminal of the mating connector so that arcing does not occur when the female terminal is disconnected initially causing an increase in the flow of voltage/current through the arc suppression element.

15. The electrical connector of claim 14, wherein the variable resistance material comprises a conductive polymer member with conductive particles immersed in a nonconductive polymer, increased resistive heating causing the nonconductive polymer to expand to disrupt conductive paths formed by interconnected conductive particles.

16. The electrical connector of claim 14, wherein an increase in resistance in the variable resistance material lags an increase in current.

17. The electrical connector of claim 13, wherein the arc suppression element comprises a positive temperature coefficient resistive material that is characterized in that an increase in electrical resistance of the arc suppression element lags an inrush current through the arc suppression element so that the arc suppression element carries a current approximately equal to the inrush current for a period of time.

18. The electrical connector of claim 13, wherein the arc suppression element includes a front end and a rear end engaging and being electrically coupled to the female terminal.

19. The electrical connector of claim 13, wherein the arc suppression element expands when heated to electrically decouple the male terminal from the female terminal.

20. The electrical connector of claim 13, wherein the arc suppression element includes a contact element configured for contact with the male terminal.

* * * * *